US010738560B2

(12) United States Patent
Duan et al.

(10) Patent No.: US 10,738,560 B2
(45) Date of Patent: Aug. 11, 2020

(54) PACKERS HAVING CONTROLLED SWELLING AND METHODS OF MANUFACTURING THEREOF

(71) Applicants: Ping Duan, Cypress, TX (US); Anil Sadana, Houston, TX (US); Wayne Furlan, Cypress, TX (US)

(72) Inventors: Ping Duan, Cypress, TX (US); Anil Sadana, Houston, TX (US); Wayne Furlan, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 206 days.

(21) Appl. No.: 15/496,034

(22) Filed: Apr. 25, 2017

(65) Prior Publication Data

US 2018/0305996 A1 Oct. 25, 2018

(51) Int. Cl.

| | |
|---|---|
| ***E21B 33/12*** | (2006.01) |
| ***E21B 23/06*** | (2006.01) |
| *E21B 23/00* | (2006.01) |

(52) U.S. Cl.

CPC ..... *E21B 33/1208* (2013.01); *E21B 23/06* (2013.01); *E21B 23/00* (2013.01)

(58) Field of Classification Search

CPC ..... E21B 33/1208; E21B 33/12; E21B 33/10; E21B 23/00; E21B 23/06

See application file for complete search history.

(56) References Cited

U.S. PATENT DOCUMENTS

| | | | | |
|---|---|---|---|---|
| 3,918,523 | A | 11/1975 | Stuber | |
| 6,245,841 | B1 | 6/2001 | Yeager et al. | |
| 7,143,832 | B2 | 12/2006 | Freyer | |
| 7,427,654 | B1 | 9/2008 | Cheng et al. | |
| 7,681,653 | B2 | 3/2010 | Korte et al. | |
| 8,877,841 | B2 | 11/2014 | Yano et al. | |
| 9,303,200 | B2 | 4/2016 | Korte et al. | |
| 9,303,202 | B2 | 4/2016 | Crabtree et al. | |
| 2005/0199401 | A1 | 9/2005 | Patel et al. | |
| 2007/0181224 | A1* | 8/2007 | Marya | C09K 8/805 148/400 |
| 2008/0149351 | A1* | 6/2008 | Marya | E21B 23/00 166/387 |

(Continued)

FOREIGN PATENT DOCUMENTS

| | | | |
|---|---|---|---|
| EP | 0396383 | A2 | 11/1990 |
| WO | 9700733 | A1 | 1/1997 |
| WO | 2014169847 | A1 | 10/2014 |

OTHER PUBLICATIONS

International Search Report, International Application No. PCT/US2018/024297, dated Jul. 13, 2018, Korean Intellectual Property Office; International Search Report 3 pages.

(Continued)

*Primary Examiner* — George S Gray

(74) *Attorney, Agent, or Firm* — Cantor Colburn LLP

(57) ABSTRACT

A sealing system for a flow channel includes a mandrel, a swellable element disposed about the mandrel, and a degradable polymeric element disposed on a surface of the swellable element and configured to delay swelling of the swellable element. The degradable polymeric element comprises one or more of the following: polyurethane; cured cyanate ester; an epoxy; polyimide; unsaturated polyester; or nylon.

16 Claims, 5 Drawing Sheets

(56) References Cited

U.S. PATENT DOCUMENTS

| | | | | |
|---|---|---|---|---|
| 2010/0116496 | A1 | 5/2010 | Allen et al. | |
| 2013/0062072 | A1* | 3/2013 | Alvarez | E21B 33/1208 166/376 |
| 2013/0245204 | A1 | 9/2013 | Pastine et al. | |
| 2014/0102726 | A1 | 4/2014 | Gamstedt et al. | |
| 2014/0221510 | A1 | 8/2014 | Liang et al. | |
| 2015/0275617 | A1* | 10/2015 | Lou | E21B 33/1208 166/387 |
| 2017/0016298 | A1* | 1/2017 | Takahashi | C08K 5/0016 |
| 2017/0218713 | A1* | 8/2017 | Walton | E21B 33/1208 |
| 2017/0314360 | A1* | 11/2017 | Levie | E21B 33/1208 |
| 2018/0118925 | A1* | 5/2018 | Gozalo | C08K 3/30 |

OTHER PUBLICATIONS

International Written Opinion, International Application No. PCT/US2018/024297, dated Jul. 13, 2018, Korean Intellectual Property Office; International Written Opinion 9 pages.

* cited by examiner

PACKERS HAVING CONTROLLED SWELLING AND METHODS OF MANUFACTURING THEREOF

BACKGROUND

Isolation of downhole environments depends on the deployment of a downhole tool that effectively seals the entirety of the borehole or a portion thereof, for example, an annulus between a casing wall and production tube. Swellable packers are particularly useful in that they are capable of generating a contact force against a nearby structure when exposed to one or more downhole fluids such as water, oil, or a combination thereof. Compared with mechanically setup packers and inflatable packers, fluid-swellable packers are easier to set up.

Oil swellable packers normally contain an elastomer such as EPDM that expands when exposed to hydrocarbon based fluids. EPDM rubber often swells rapidly in the oil or oil based fluids and can seal a borehole within one or two days at elevated temperatures. However, under certain circumstances, it is desirable to delay the swelling of the packers to allow the operator to have more time to carry out various completion operations. Such delayed swelling period can be a few days or weeks.

One possible solution is to dispose an outer layer on an EPDM elastomer core to regulate the amount of well fluids that can reach the elastomer core thus controlling the swelling rate of the core. While such proposed packers may have a delayed swelling rate, the outer layer can prevent the core from reaching its full expansion potential and adversely affect the formation of an effective seal. Thus, alternative sealing elements having controlled swelling are desired in the art.

BRIEF DESCRIPTION

Disclosed herein is a sealing system for a flow channel. The sealing system comprises a mandrel; a swellable element disposed about the mandrel; and a degradable polymeric element disposed on a surface of the swellable element and configured to delay swelling of the swellable element; wherein the degradable polymeric element comprises one or more of the following: polyurethane; cured cyanate ester; an epoxy; polyimide; unsaturated polyester; or nylon.

A method of sealing comprises disposing a sealing system in a wellbore; the sealing system comprising: a mandrel; a swellable element disposed about the mandrel; and a degradable polymeric element disposed on a surface of the swellable element and configured to delay swelling of the swellable element; the degradable polymeric element comprising one or more of the following: polyurethane; cured cyanate ester; an epoxy; polyimide; unsaturated polyester; or nylon; exposing the degradable polymeric element to a degradation fluid; removing the degradable polymeric element by degradation; and allowing the swelling element to swell.

A method of manufacturing a sealing system comprises disposing a mandrel that carries a swellable element in a mold; injecting a liquid composition into the mold under pressure; applying a temperature to the mold; and curing the liquid composition; wherein the cured liquid composition forms a degradable polymeric element disposed on a surface of the swellable element; the degradable polymeric element comprising one or more of the following: a polyurethane; cured cyanate ester; an epoxy; polyimide; unsaturated polyester; nylon; or a precursor thereof.

In another embodiment, a method of manufacturing a sealing system comprises applying a liquid composition to a rotating swellable element disposed about a mandrel; and curing the liquid composition applied to the swellable element; wherein the cured liquid composition forms a degradable polymeric element disposed on a surface of the swellable element; the degradable polymeric element comprising one or more of the following: a polyurethane; cured cyanate ester; an epoxy; polyimide; unsaturated polyester; nylon; or a precursor thereof.

BRIEF DESCRIPTION OF THE DRAWINGS

The following descriptions should not be considered limiting in any way. With reference to the accompanying drawings, like elements are numbered alike.

DETAILED DESCRIPTION

The inventors hereof have found that a layer of degradable polymeric material can be formed on a surface of a swellable element to delay and control the swelling rate of the swellable element. Advantageously the degradable polymeric material is molded on a swellable element and cured forming a void-free layer, which is chemically bonded to the swellable element.

The layer formed from the degradable polymeric material is not permeable to oil, water, or a combination thereof thus effectively prevents the premature exposure of the swellable element to oil or water. Meanwhile, the degradable polymeric material can be engineered to gradually and slowly degrade or decompose for a certain period of time at a given temperature such that when the completion operations are finished, the layer of the degradable polymeric material is discomposed exposing the swellable element. The exposed swellable element can them swell and seal a wellbore. Since the degradable polymeric material can be completely degraded as liquids or small pieces of solids, it does not confine the swelling capacity of the swellable element.

Figure 1:
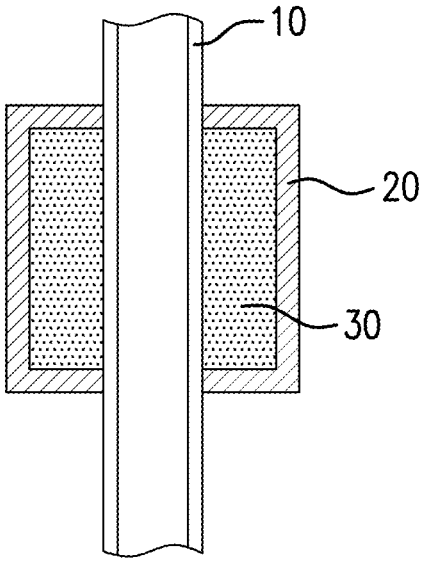
FIG. 1 is a cross-sectional view of a sealing system having a central support substrate or pipe that bears a swellable element according to an embodiment of the disclosure in an original, non-expanded shape.
Figure 2:
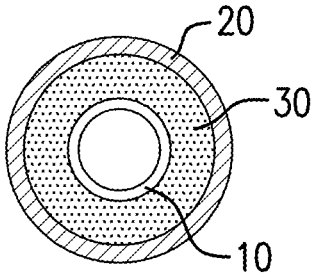
FIG. 2 is a cross-sectional view of the sealing system shown in FIG. 1.

As shown in FIGS. 1 and 2, a sealing system includes a mandrel 10, a swellable element 30 disposed about the mandrel 10, and a degradable polymeric element 20 disposed on a surface of the swellable element 30 and configured to delay swelling of the swellable element 30.

The degradable polymeric element comprises one or more of the following: polyurethane; cured cyanate ester; an epoxy; polyimide; unsaturated polyester; or nylon. Degradation rate of the degradable polymeric element varies depending on the material used. Different polymers can be used together to reach optimal and desirable degradation rate.

The polyurethane in the degradable polymeric component comprises one or more of ester groups, carbonate groups, or ether groups in a backbone of the polyurethane. The ester groups are specifically mentioned. Suitable ester groups include linear ester groups or cyclic ester groups such as caprolactone. As used herein, a backbone of the polyurethane refers to a main chain of the polyurethane comprising covalently bounded atoms that together create a continuous polymer chain of the molecule.

The polyurethane can be derived from a polyurethane forming composition comprising a polyisocyanate and a polyol, wherein at least one of the polyisocyanate and the polyol comprise ester groups, carbonate groups, ether groups or a combination comprising at least one of the foregoing. Alternatively or in addition, the polyurethane forming composition comprises a polyurethane prepolymer and a curative, wherein the polyurethane prepolymer has ester groups, carbonate groups, ether groups, or a combination comprising at least one of the foregoing.

The polyisocyanate may be one or more of any of a number of polyisocyanates that are known for applications in the production of polyurethanes. Exemplary polyisocyanates include, but are not limited to aromatic polyisocyanates, such as diphenylmethane diisocyanate (MDI, e.g., 4,4'-MDI, blends of 4,4'-MDI and 2,4'-MDI), MDI prepolymer, and modified polymeric MDI containing monomeric MDI, toluene diisocyanate (TDI), p-phenylene diisocyanate (PPDI), naphthalene diisocyanate (NDI), and o-tolidine diisocyanate (TODI), as well as aliphatic polyisocyanates such as 1,6-hexamethylene diisocyanate (HDI), isophorone diisocyanate (IPDI), tetramethylxylene diisocyanate (TMXDI), and cyclohexane diisocyanate (CHDI). Mixtures of any of the aforementioned polyisocyanates or other known polyisocyanates may also be used. In an exemplary embodiment, the polyisocyanate is a modified MDI (e.g., MONDUR PC sold by Bayer) or MDI prepolymer (e.g., LUPRANATE 5040 sold by BASF). The polyisocyanate can contain ester groups, carbonate groups, ether groups, or a combination comprising at least one of the foregoing.

The polyol portion may include, but not necessarily be limited to, polyether polyols (e.g., prepared by reaction of ethylene oxide and/or propylene oxide with polyol initiators such as propylene glycol, glycerine, sorbitol, or sucrose, to name a few), polyester polyols (e.g., prepared by polyesterification of low molecular weight polyacids such as malonic acid, succinic acid, adipic acid, carballylic acid with low molecular weight polyols such as propylene glycol, 1,4-butane diol, and the like, and also polycaprolactone polyols), polycarbonate polyols, polybutadiene polyols, and the like.

In an exemplary embodiment, ester linkages in the backbone of the polyurethane are incorporated by including a polyester polyol in the reaction mixture. In a further exemplary embodiment, a polyester polyol in a polyurethane reaction mixture may have a molecular weight of from 1000 to 2000 and an OH number of from 50 to 130. Exemplary polyester polyols include, but are not limited to FOMREZ 45, FOMREZ 1023-63, FOMREZ 1066-187, and FOMREZ 1066-560 from Chemtura.

Alternatively or in addition, the polyurethane material may also be formed by reacting polyurethane prepolymers and curatives. Polyurethane prepolymers are formed by reacting polyols with diisocyanates. In an embodiment, the polyurethane prepolymers have reactive isocyanate end groups and are formed by reacting a stoichiometric excess of a diisocyanate as described herein with a polyol as described herein. These polyurethane prepolymers are generally stable in a closed container, but reactive when they are contacted with chemicals such as water, diols, diamines, etc., forming high molecular polymers. In an embodiment, the polyurethane prepolymer is a TDI-based polyester containing reactive isocyanate end groups. Polyurethane prepolymers are commercially available from companies such as Bayer Corporation or BASF or Chemtura Corporation.

The polyurethane prepolymers containing isocyanate ended reactive groups can react with curatives including diols such as 1,4-butanediol, 1,3-propanediol, hydroquinone bis (beta-hydroxyethyl) ether (HQEE), or di-amines such as 4,4-methylene bis (2-chloroaniline) "MOCA", 1,3 Propanediol bis-(4-aminobenzoate), diethyltoluenediamine, dimethylthiotoulenediamine. In an embodiment the polyurethane prepolymer containing isocyanate ended reactive groups is used in combination with a polyisocyanate as described herein to further adjust the degradation properties of the polymer composition.

Polyurethane forming compositions may also include small amounts of chain-extenders (low molecular weight diols or diamines) such as 1,4-butanediol, 1,3-propanediol, ethylene glycol, propylene glycol, ethanolamine, or diethyltoluenediamine, or dimethylthiotoluenediamine (DMTDA). Other suitable chain extenders include but are not limited to 4,4'-Methylene bis (2-chloroaniline), "MOCA", sold by Chemtura under the commercial name VIBRA-CURE A 133 HS, and trimethylene glycol di-p-aminobenzoate, "MCDEA", sold by Air Products under the commercial name VERSALINK 740M. The polyurethane forming composition may also include cross-linkers (low molecular weight polyfunctional alcohols or amines) such as trimethylol propane (TMP), triethanolamine (TEA), or N,N,N',N'-tetrakis(2-hydroxypropyl) ethylenediamine. Catalysts, such as amine catalysts (e.g., tertiary amines such as triethylenediamine), organometallic catalysts, trimerization catalysts (e.g., 1,3,5-(tris(3-dimethylamino)propyl)-hexahydro-s-triazine) may also be included in the reaction mixture.

In an embodiment, the polyurethane comprises ester groups in a backbone of the polyurethane and carboxylic acid groups attached to the backbone of the polyurethane. The carboxylic acid groups can be covalently bounded to the backbone of the polyurethane. Alternatively or in addition, one or more intervening groups or atoms can be present between the backbone of the polyurethane and the carboxylic acid functional groups. In a specific embodiment, the carboxylic acid groups are directly bounded to the backbone of the polyurethane without any intervening atoms.

By using a carboxylic acid functionalized alcohol, carboxylic acid groups are incorporated into the polyurethane molecular backbone. In an embodiment, carboxylic acid groups are introduced through di-functional hydroxyl groups which react with polyisocyanates or polyurethane prepolymers as shown in the following scheme:

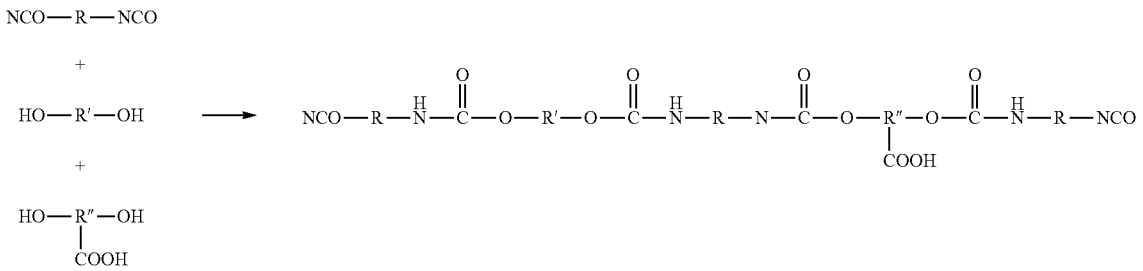

In the above reaction, NCO—R—NCO represents a polyisocyanate or a polyurethane prepolymer having reactive isocyanate end groups. Compound HO—R'—OH can represent a polyol or a curative for the prepolymer, and HO—R"(COOH)—OH represents the carboxylic acid functionalized alcohol, wherein R, R', and R" are independently organic divalent radicals. Without wishing to be bound by theory, it is believed that the incorporation of carboxylic acid groups into the backbone of the polyurethane contributes to the improved degradation of the polymer composition.

The carboxylic acid functionalized alcohol can comprise at least two hydroxyl groups. In an embodiment, the carboxylic acid functionalized alcohol comprises 2,2-bis(hydroxymethyl)propionic acid (DMPA).

In a non-restrictive embodiment, the polyurethane forming composition comprises a TDI-terminated polyester prepolymer such as ADIPRENE 1950A from Chemtura Corporation; a curative such as 1, 3-propanediol bis-(4-aminobenzoate).

In a non-restrictive embodiment, the isocyanate portion may contain modified MDI such as MONDUR PC sold by Bayer or MDI prepolymer such as LUPRANATE 5040 sold by BASF or MONDUR 501 sold by Bayer (an isocyanate-terminated MDI polyester prepolymer), and the polyol portion may contain (1) a polyether or polyester or polycarbonate polyol; (2) a tri-functional hydroxyl cross linker such as trimethylolpropane (TMP); (3) an chain extender such as 1,4-butanediol; and (4) a carboxylic acid functionalized alcohol such as 2,2-bis(hydroxymethyl)propionic acid (DMPA). Other additives may include catalyst, fillers, lubricants, colorants, etc.

In another non-restrictive embodiment, the polyurethane forming composition comprises a TDI-terminated polyester prepolymer such as ADIPRENE 1950A from Chemtura Corporation; a curative such as hydroquinone bis (beta-hydroxyethyl) ether (HQEE) or 1,4-butanediol; a tri-functional hydroxyl cross linker such as trimethylolpropane (TMP); a carboxylic acid functionalized alcohol such as 2,2-bis(hydroxymethyl)propionic acid (DMPA); and optionally a polyisocyanate, for example, a MDI prepolymer such as LUPRANATE 5040 sold by BASF or MONDUR 501 sold by Bayer (an isocyanate-terminated MDI polyester prepolymer).

The amount of polyisocyanate and/or the polyurethane prepolymer used in the polyurethane-forming composition can vary, depending upon the particular application for which the polyurethane is being prepared. In general, the total —NCO equivalents to total active hydroxyl equivalents is such as to provide a ratio of 0.8 to 1.2 equivalents of —NCO per equivalent of active hydroxyl groups, and preferably a ratio of about 1.0 to 1.08 equivalents of —NCO per active hydroxyl. The active hydroxyl groups can be provided by polyols, cross linking agents, chain extenders, or a combination comprising at least one of the foregoing.

Cyanate esters are compounds generally based on a phenol or a novolac derivative, in which the hydrogen atom of the phenolic OH group is substituted by a cyanide group (—OCN). Suitable cyanate esters include those described in U.S. Pat. No. 6,245,841 and EP 0396383. In an embodiment, cyanate esters are based on resorcinol, p,p'-dihydroxydiphenyl, o,p'-dihydroxydiphenyl methane, 2,2-bis(4-hydroxyphenyl)propane (bisphenol A), tetramethylbisphenol F, hexafluorobisphenol A, bisphenol E, bisphenol M, dicyclopentadienyl bisphenol, o,p'-dihydroxydiphenyl methane, p,p'-dihydroxydiphenyl propane, p,p'-dihydroxydiphenyl sulfone, p,p'-dihydroxydiphenyl sulfide, p,p'-dihydroxydiphenyl oxide, 4,4'-methylenebis(2,6-dimethyl phenol), p,p',p"-tri-hydroxy triphenyl ethane, dihydroxynaphthalene and novolac resins which contain more than 2 phenol moieties per moleculeor, or a combination thereof.

Cyanate esters can be cured and postcured by heating, either alone, or in the presence of a catalyst. Curing normally occurs via cyclotrimerization (an addition process) of three CN groups to form three-dimensional networks comprising triazine rings. The residual cyanate ester content can be determined quantitatively by methods known in the art, for example, by infrared analysis or by "residual heat of reaction" using a differential scanning calorimeter.

As used herein, a "cured cyanate ester" means that cyanate ester monomers are cured until at least about 70 percent, at least about 80 percent, at least about 85 percent, or at least about 90 percent of the cyanate functional groups are cyclotrimerized. The curing reaction can be conducted at about 150° F. to about 600° F. or about 200° F. to about 500° F. If a catalyst is present, the curing temperature can be lower. Suitable curing catalysts include an active-hydrogen catalyst or transition metal complexes of cobalt, copper, manganese and zinc. Advantageously, cured cyanate esters are controllably degradable in water or brine at elevated temperatures. Without wishing to be bound by theory, it is believed that the cured cyanate ester undergoes hydrolysis reactions eventually producing ammonia and a bisphenol.

As used herein, an epoxy polymer refers to a polymer derived from an epoxy base and a curing agent having cleavable bonds. The epoxy base includes a glycidyl ether epoxy resin, glycidyl ester epoxy resin, glycidyl amine epoxy resin, trifunctional epoxy resin, tetrafunctional epoxy resin, novolac epoxy resin, cresol-novolac epoxy resin, aliphatic epoxy resin, alicyclic epoxy resin, or nitrogen containing epoxy resin. In an embodiment, the epoxy base is bisphenol A diglycidyl ether, for example, Epon* 828, commercially available from Momentive Performance Materials Inc.

Degradable curing agents include those disclosed in US Patent Publication Nos. 2013/0245204 and 2014/0221510 and WO 2014/169847, the disclosure of each of which is incorporated herein by reference in its entirety. The curing agents have at least one cleavable bond, which can be cleaved upon exposure to an organic acid or an acidified ethylene glycol. In an embodiment, the curing agent is a polyamine such as a diamine. Exemplary degradable curing agents are Recyclamine* commercially available from Connora Tech. and Cleavamine* commercially available from Addesso Advanced Materials.

The epoxy base can be cured or crosslinked under known conditions using the curing agent described herein. The cured or crosslinked epoxy polymer can have a density of 1.2 g/cc, and a glass transition temperature (Tg) of about 100° C. to about 300° C.

Exemplary degradable polyimides include those derived from a monomer containing at least two anhydride groups, or a derivative thereof, and a monomer containing at least two primary amine groups and at least one acidic group, or a derivative thereof. The monomers containing at least two anhydride groups may be those used in the preparation of non-degradable polyimides, including, but not limited to, pyromellitic dianhydride (PMDA), 3,3',4,4'-biphenyltetracarboxylic dianhydride (BPDA), 3,3',4,4'-benzophenonetetracarboxylic dianhydride (BTDA), 3,3',4,4'-oxydiphthalic anhydride (ODPA), and 4,4'-hexafluoroisopropylidenebisphthalic anhydride (6FDA). The monomers containing at least two amine groups and at least one acidic group (such as carboxylic acid or sulfinic acid) may be naturally occurring or synthetic amino acids (.alpha., .beta.-diaminopropionic acid, .alpha., .gamma.-diaminobutyric acid, omithine, lysine, 2,5-diaminoadipic acid, 2,6-diaminopimelic acid, 2,6-diamino-4-hexenoic acid, 2,7-diaminosuberic acid, 2,8-diaminoazelaic acid, cystine, dicarboxidine, arginine, or asparagines) or other synthetic compounds containing at least two amino groups and one acid group, and derivatives/analogues thereof. When the said monomers are biologically active, polyimides with therapeutic properties or polymeric prodrugs may also result. Exemplary degradable polyimides are described in U.S. Pat. No. 7,427,654.

Unsaturated polyesters used in the degradable polymeric element are obtained by condensing polyhydric alcohol with at least one polycarboxylic acid and/or anhydride of polycarboxylic acid to form a condensation product, then dissolving the condensation product in a vinyl unsaturated monomer. Unsaturated polyesters are known and suitable unsaturated polyesters include those described in U.S. Pat. No. 8,877,841.

Examples of the unsaturated dicarboxylic acids and/or their anhydrides include maleic acid, maleic anhydride, fumaric acid, itaconic acid, itaconic acid anhydride, and the like. Examples of the saturated dicarboxylic acids and/or their anhydrides include phthalic acid, phthalic anhydride, halogenated phthalic anhydride, isophthalic acid, terephthalic acid, tetrahydrophthalic acid, tetrahydrophthalic anhydride, hexahydrophthalic acid, hexahydrophthalic anhydride, hexahydroterephthalic acid, hexahydroisophthalic acid, succinic acid, malonic acid, glutaric acid, adipic acid, sebacic acid, 1,12-dodecanedioic acid, 2,6-naphthalenedicarboxylic acid, 2,7-naphthalenedicarboxylic acid, 2,3-naphthalenedicarboxylic acid, 2,3-naphthalenedicarboxylic anhydride, 4,4'-biphenyldicarboxylic acid, and dialkyl esters thereof. These may be used singly or in a combination of two or more polycarboxylic acids. For example, the acids can be a combination of unsaturated dicarboxylic acids and saturated dicarboxylic acids.

Examples of polyhydric alcohols include ethylene glycol, diethylene glycol, triethylene glycol, polyethylene glycol, propylene glycol, dipropylene glycol, polypropylene glycol, 2-methyl-1,3-propanediol, 1,3-butanediol, neopentyl glycol, hydrogenated bisphenol A, 1,4-butanediol, adducts of bisphenol A with propylene oxide or ethylene oxide, 1,2,3,4-tetrahydroxybutane, glycerin, trimethylolpropane, 1,3-propanediol, 1,2-cyclohexane glycol, 1,3-cyclohexane glycol, 1,4-cyclohexane glycol, 1,4-cyclohexanedimethanol, paraxylene glycol, bicyclohexyl-4,4'-diol, 2,6-decalin glycol, 2,7-decalin glycol, and the like. These may be used singly or in a combination of two or more polyhydric alcohols.

Examples of vinyl monomers include styrene, vinyl toluene, chlorostyrene, diallyl phthalate, triallyl cyanurate, methyl methacrylate, and the like. These may be used singly or in a combination of two or more monomers.

In a specific embodiment, the acid anhydride comprises maleic anhydride, phthalic anhydride, dicyclopentadiene, isophthalic acid or a combination thereof, the dihydric alcohol comprises propylene glycol, and the vinyl unsaturated monomer comprises styrene.

The unsaturated polyester can be further crosslinked. Examples of crosslinking agents include polyfunctional vinyl monomers such as divinylbenzene, and polyfunctional (meth)acrylate, other than the above-described vinyl monomers. The crosslinking agent may be used singly or in a combination of two or more crosslinking agents.

Vinyl ester resins are resins having unsaturated sites only in the terminal position. The unsaturated sites can be introduced by reaction of epoxy such as diglycidyl ether of bisphenol-A, epoxies of phenol-novolac type, or epoxies based on tetrabromobrisphenol-A with (meth)acrylic acid or (meth)acrylamide.

The vinyl ester can be further crosslinked. Examples of crosslinking agents include polyfunctional vinyl monomers such as divinylbenzene, and polyfunctional (meth)acrylate, other than the above-described vinyl monomers. The crosslinking agent may be used singly or in a combination of two or more crosslinking agents.

Fillers, pigments, short fibers, or a combination comprising at least one of the foregoing may also be used tougher with the degradable polymer either to accelerate degradation or to slow degradation or to improve mechanical properties or to have a desired color.

The thickness of the degradable polymeric element is about 1/32 of an inch to about 1/4 of an inch, specifically about 1/16 of an inch to about 1/4 of an inch. Advantageously, the degradable polymeric element is void free. The degradable polymeric element can completely encompass the swellable element. In an embodiment, the degradable polymeric element does not have any apertures.

The swellable element provides excellent swelling volumes when exposed to oil, water, or a combination comprising at least one of the foregoing. Oil swellable element can contain an elastomer such as ethylene propylene diene monomer (EPDM), acrylonitrile butadiene rubber (NBR), synthetic rubbers based on polychloroprene (NEOPRENE™ polymers from DuPont), fluorinated polymer rubbers (e.g. FKM), perfluorocarbon rubber (FFKM), tetrafluoro ethylene propylene rubbers (FEPM, such as AFLAS™ fluoroelastomers available from Asahi Glass Co. Ltd.), fluorosilicone rubber (FVMR), butyl rubbers (IIR), and the like.

Water swellable element can include the elastomer as described herein such as NBR and a super absorbent material. NBR can be crosslinked. The crosslinks are a product of crosslinking the polymer by sulfur, peroxide, urethane, metallic oxides, acetoxysilane, and the like. In particular, a sulfur or peroxide crosslinker is used.

Additives such as fillers, activators, antioxidants, processing acids, and curatives can be included in the swellable element. Known additives are described for example in U.S. Pat. No. 9,303,200.

Figure 3:
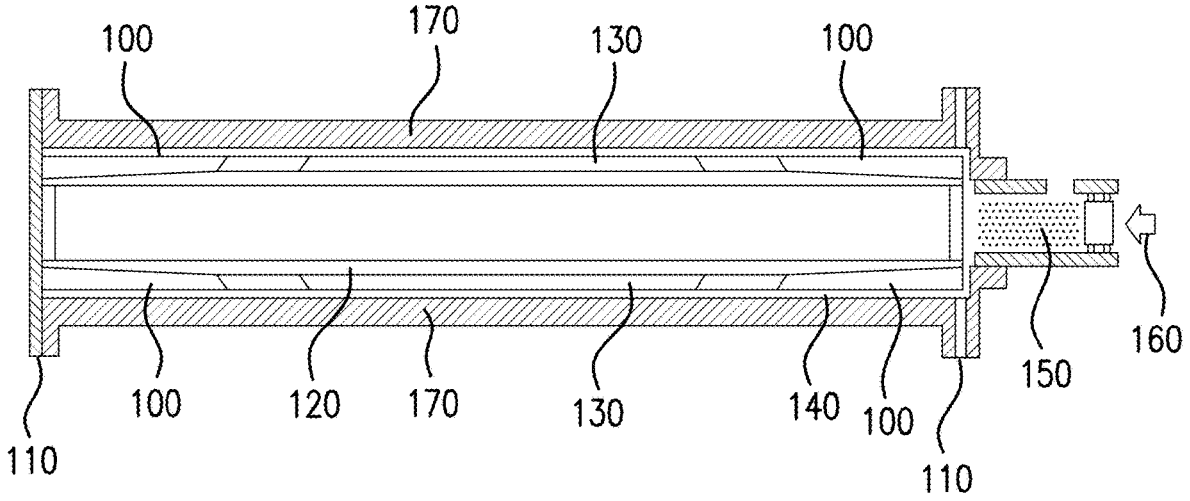
FIG. 3 illustrates an exemplary method of making the sealing system of FIG. 1 according to an embodiment of the disclosure.

The sealing system can be manufactured by molding. An exemplary method is illustrated in FIG. 3. As shown in FIG. 3, the method comprises disposing a mandrel 120 that carries a swellable element 130 in a mold 170; injecting a liquid composition 150 into the mold under pressure; applying a temperature to the mold; and curing the liquid composition. Upon curing, the liquid composition forms a degradable polymeric element disposed on a surface of the swellable element.

The mold 170 can further include end plates 110 and a pair of spacers 140 disposed at opposing ends of the mold. During the manufacturing process, the mandrel that carries the swellable element is disposed between the pair of spacers. Thereafter, the liquid composition is poured or extruded under pressure 160 via an extruder into the mold. The liquid composition can fill the empty space 100 between the walls of the mold, the spacers and the swellable article. In an embodiment, the portion of the mandrel that does not carry the swellable element is not exposed to the liquid composition because that portion is covered by the spacers.

The liquid composition includes a precursor such as a prepolymer or oligomer of a polyurethane; cyanate ester; an epoxy; polyimide; unsaturated polyester; or nylon and a curing agent or crosslinking agent. In an embodiment, the liquid composition contains a polyurethane forming composition as disclosed herein.

Molding is conducted at a temperature of about 60° C. to 150° C. and a pressure of about 1,000 psi to about 50,000 psi. Specifically, molding is conducted at a temperature of about 80° C. to 120° C. and a pressure of about 5,000 psi to about 10,000 psi. Under the molding conditions, the liquid composition is cured and forms the degradable polymeric element disposed on a surface of the swellable element and configured to delay swelling of the swellable element. Advantageously, the polymeric element is chemically bonded to the swellable element.

Figure 4:
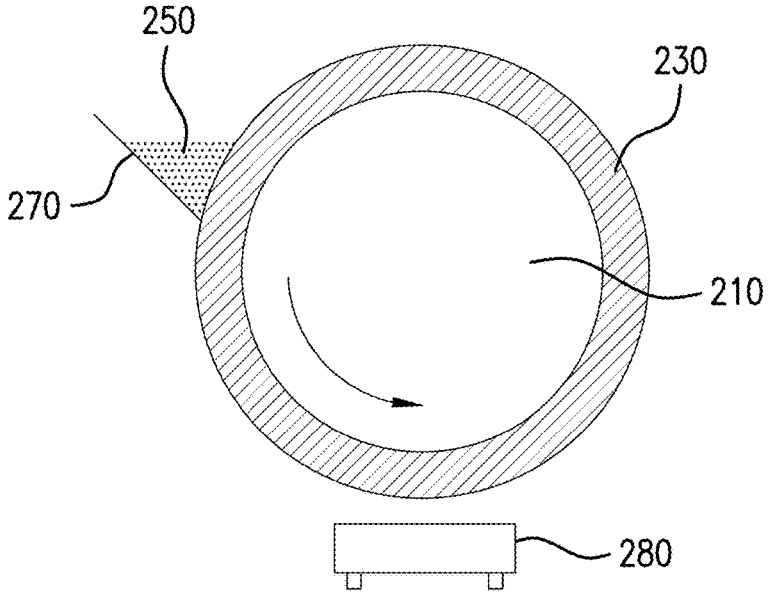
FIG. 4 illustrates an exemplary method according to an embodiment of the disclosure to manufacture the sealing system shown in FIG. 1.
Figure 5:
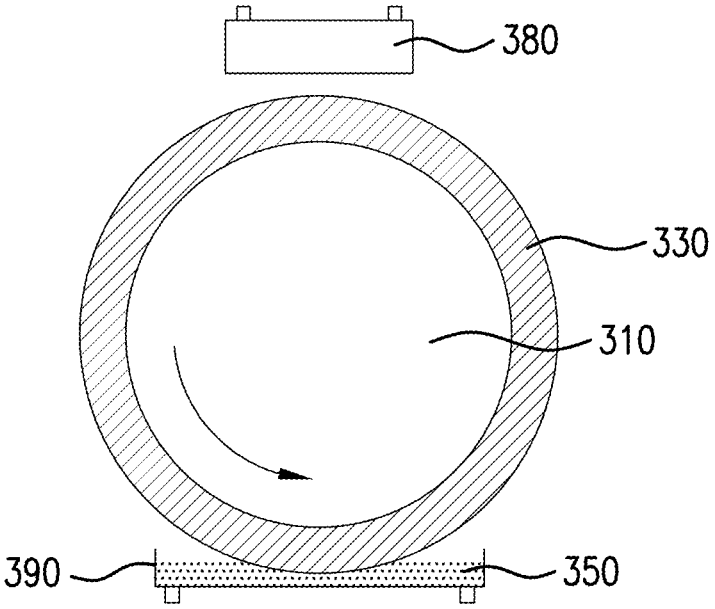
FIG. 5 illustrates another exemplary method according to an embodiment of the disclosure to manufacture the sealing system shown in FIG. 1.
Figure 6A:
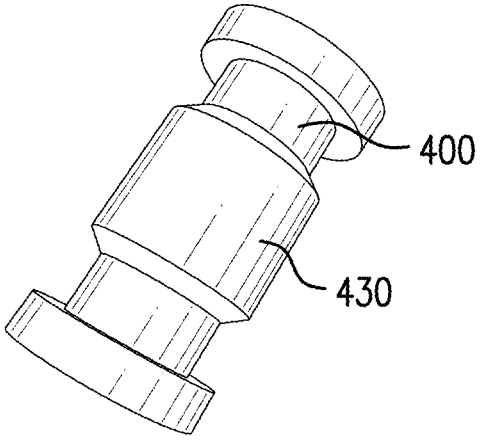
FIG. 6A shows a base sample including a swellable elastomer disposed on a metallic substrate.
Figure 6B:
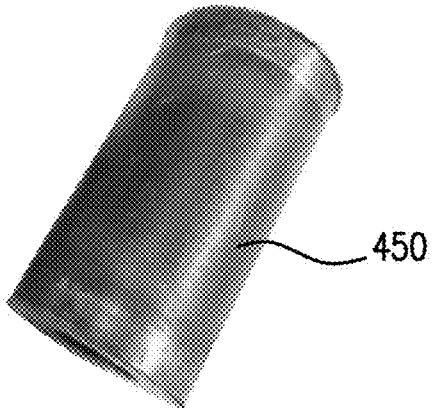
FIG. 6B shows a sample sealing system including the base of FIG. 6A and a degradable element disposed on a surface of the swellable element before the swelling test.
Figure 6C:
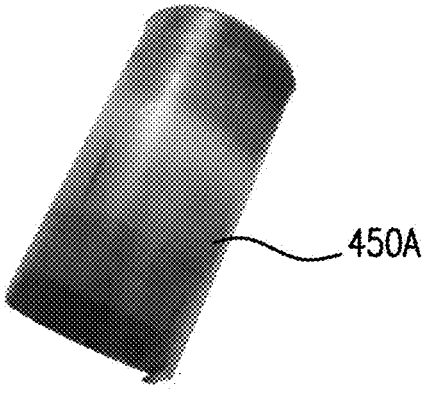
FIG. 6C shows the sample sealing system of FIG. 6B after the sample is exposed to an oil-based mud at 220° F. in a pressure cell for 5 days.
Figure 6D:
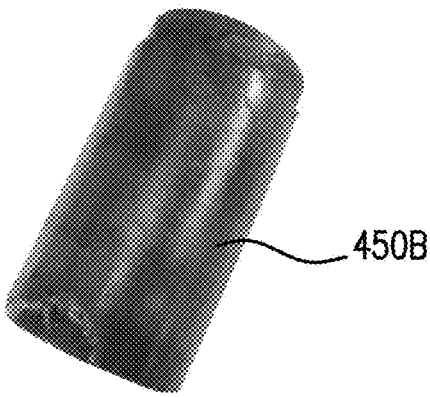
FIG. 6D shows the sample sealing system of FIG. 6B after the sample is exposed to an oil-based mud at 220° F. in a pressure cell for 15 days.
Figure 6E:
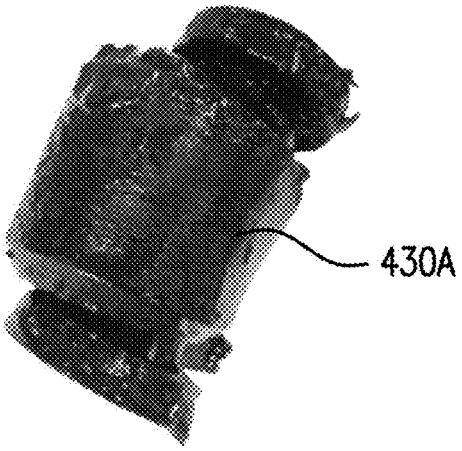
FIG. 6E shows the sample sealing system of FIG. 6B after the sample is exposed to an oil-based mud at 220° F. in a pressure cell for 20 days.
Figure 6F:
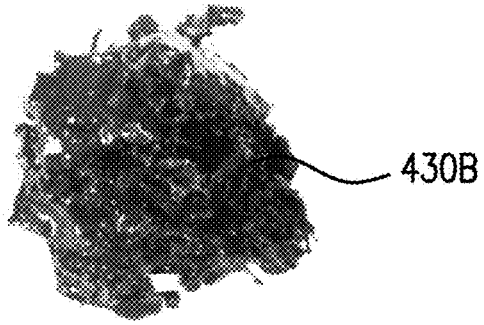
FIG. 6F shows the debris of degradable polymer after degradation.

Alternative methods of manufacturing the sealing system are illustrated in FIGS. 4 and 5. The methods comprise applying a liquid composition (250, 350) to a rotating swellable element (230, 330) disposed about a mandrel (210, 310); and curing the liquid composition applied to the swellable element. The liquid composition can be held in a container 390, and is applied to the swellable element when the rotating swellable element comes into contact with the liquid composition. Alternatively the liquid composition is applied to the rotating swellable element via a blade 270. The liquid composition can be cured by a hot plate 280 or a heating lamp 380. Other heating sources known in the art can also be used.

The sealing system can be used to seal a wellbore. The method comprises disposing the sealing system in a wellbore; removing the degradable polymeric element by degradation; and allowing the swelling element to swell.

The degradable element degrades when exposed to a fluid at a temperature of about 25° C. to about 300° C., about 65° C. to about 250° C., or about 65° C. to about 150° C. or about 175° C. to about 250° C. The pressure can be about 100 psi to about 15,000 psi. Depending on the time needed to finish the completion operations, the degradable element can be removed in less than or equal to about 25 days, in less than or equal to about 20 days, or in less than or equal to about 15 days. Advantageously, the degradable element is removed at least three days, at least five days, or at least one week after the sealing system is deployed downhole.

The fluid can comprises water, brine, an acid, a base, or a combination comprising at least one of the foregoing. The brine can include NaCl, KCl, NaBr, $MgCl_2$, $CaCl_2$, $CaBr_2$, $ZnBr_2$, $NH_4Cl$, sodium formate, cesium formate, and the like. The fluid can be a wellbore fluid generated downhole. Alternatively, to further control the swelling profile of swellable element, a fluid such as an acid can be introduced downhole to accelerate the degradation of the degradable element at the time when sealing is desired.

A sample sealing system was prepared using the molding method as illustrated in FIG. 3. The sample includes a mandrel 400, a swellable element 430 containing EPDM, and a disintegrable element 450 disposed on a surface of the swellable element 430. The sample was placed insider a pressure cell, which was filled with an oil based drilling mud having about 20% water by weight. The pressure cell was heated to about 220° F., and the diameters of the sample were measured. A base sample without the degradable element, a sealing sample with the degradable element before and after the swelling tests and the debris of the degraded polymer are shown in FIGS. 6A-6F. It was observed that the diameter of the sample increased by only 0.3% after the sample was placed in the pressure cell at 220° F. for 5 days, and the diameter of the sample increased by 3% after the sample was placed in the pressure cell at 220° F. for 15 days. The results indicate that the degradable polymeric element can effectively delay swelling of the swellable element.

Set forth below are various embodiments of the disclosure.

Embodiment 1

A sealing system for a flow channel comprising: a mandrel; a swellable element disposed about the mandrel; and a degradable polymeric element disposed on a surface of the swellable element and configured to delay swelling of the swellable element; wherein the degradable polymeric element comprises one or more of the following: polyurethane; cured cyanate ester; an epoxy; polyimide; unsaturated polyester; or nylon.

Embodiment 2

The sealing system of Embodiment 1, wherein the degradable polymeric element has a thickness of about 1/32 of an inch to about 1/4 of an inch.

Embodiment 3

The sealing system of Embodiment 1 or Embodiment 2, wherein the degradable polymeric element has a thickness of about 1/16 of an inch to about 1/4 of an inch.

Embodiment 4

The sealing system of any one of Embodiments 1 to 3, wherein the swellable element is chemically bonded to the degradable polymeric element.

Embodiment 5

The sealing system of any one of Embodiments 1 to 4, wherein the polyurethane further comprises one or more of the following groups: ester groups; carbonate groups; or ether groups.

Embodiment 6

The sealing system of any one of Embodiments 1 to 5, wherein the polyurethane comprising ester groups in a backbone of the polyurethane and carboxylic acid groups attached to the backbone of the polyurethane.

Embodiment 7

The sealing system of any one of Embodiments 1 to 6, wherein the swellable element is impermeable to oil, water, or a combination thereof.

Embodiment 8

The sealing system of any one of Embodiments 1 to 7, wherein the sealing element is a packer or a bridge plug.

Embodiment 9

A method of sealing, the method comprising: disposing a sealing system in a wellbore; the sealing system comprising: a mandrel; a swellable element disposed about the mandrel; and a degradable polymeric element disposed on a surface of the swellable element and configured to delay swelling of the swellable element; the degradable polymeric element comprising one or more of the following: polyurethane; cured cyanate ester; an epoxy; polyimide; unsaturated polyester; or nylon; exposing the degradable polymeric element to a degradation fluid; removing the degradable polymeric element by degradation; and allowing the swelling element to swell.

Embodiment 10

The method of Embodiment 9, wherein the degradation fluid comprises at least one of the following: water; brine; an acid; or a base.

Embodiment 11

The method of Embodiment 9 or Embodiment 10, wherein the degradation fluid is generated downhole.

Embodiment 12

The method of Embodiment 9 or Embodiment 10, wherein the degradation fluid is introduced into the wellbore.

Embodiment 13

The method of any one of Embodiments 9 to 12, wherein the degradable polymeric element chemically reacts with at least one material in the degradation fluid to decompose.

Embodiment 14

The method of any one of Embodiments 9 to 13, wherein the swellable element is chemically bonded to the degradable polymeric element.

Embodiment 15

The method of any one of Embodiments 9 to 14, wherein the polyurethane further comprises one or more of the following groups: ester groups; carbonate groups; or ether groups.

Embodiment 16

The method of any one of Embodiments 9 to 15, wherein the polyurethane comprising ester groups in a backbone of the polyurethane and carboxylic acid groups attached to the backbone of the polyurethane.

Embodiment 17

A method of manufacturing a sealing system, the method comprising: disposing a mandrel that carries a swellable element in a mold; injecting a liquid composition into the mold under pressure; applying a pressure to the mold; and curing the liquid composition; wherein the cured liquid composition forms a degradable polymeric element disposed on a surface of the swellable element; the degradable polymeric element comprising one or more of the following: a polyurethane; cured cyanate ester; an epoxy; polyimide; unsaturated polyester; nylon; or a precursor thereof.

Embodiment 18

The method of Embodiment 17, wherein the mold further comprises a pair of spacers disposed at opposing ends of the mold, and the method further comprises disposing the mandrel that carries the swellable element between the pair of spacers.

Embodiment 19

The method of Embodiment 17 or Embodiment 18, wherein the temperature applied to the mold is about 60° C. to 150° C. and a pressure applied to the mold is about 1,000 psi to about 50,000 psi.

Embodiment 20

A method of manufacturing a sealing system, the method comprising: applying a liquid composition to a rotating swellable element disposed about a mandrel; and curing the liquid composition applied to the swellable element; wherein the cured liquid composition forms a degradable polymeric element disposed on a surface of the swellable element; the degradable polymeric element comprising one or more of the following: a polyurethane; cyanate ester; an epoxy; polyimide; unsaturated polyester; nylon; or a precursor thereof.

Embodiment 21

The method of Embodiment 20, wherein curing the liquid composition comprises heating the liquid composition applied to the swellable element.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety. The wellbore can be vertical, deviated or horizontal.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity).

The invention claimed is:

1. A sealing system for a flow channel comprising:

a mandrel;

a swellable element disposed about the mandrel; and a degradable polymeric element disposed on a surface of the swellable element and configured to delay swelling of the swellable element;

wherein the degradable polymeric element comprises a polyurethane, which comprises ester groups and carbonate groups in a backbone of the polyurethane; and the swellable element is chemically bonded to the degradable polymeric element.

2. The sealing system of claim 1, wherein the degradable polymeric element has a thickness of about 1/32 of an inch to about 1/4 of an inch.

3. The sealing system of claim 1, wherein the degradable polymeric element has a thickness of about 1/16 of an inch to about 1/4 of an inch.

4. The sealing system of claim 1, wherein the polyurethane is cured.

5. The sealing system of claim 1, wherein the degradable polymeric element is impermeable to oil, water, or a combination thereof.

6. The sealing system of claim 1, wherein the sealing element is a packer or a bridge plug.

7. A method of sealing, the method comprising:

disposing a sealing system in a wellbore; the sealing system comprising:

a mandrel;

a swellable element disposed about the mandrel; and a degradable polymeric element disposed on a surface of the swellable element and configured to delay swelling of the swellable element; the degradable polymeric element comprising a polyurethane, which comprises ester groups and carbonate groups in a backbone of the polyurethane;

exposing the degradable polymeric element to a degradation fluid;

removing the degradable polymeric element by degradation; and allowing the swelling element to swell, wherein the swellable element is chemically bonded to the degradable polymeric element.

8. The method of claim 7, wherein the degradation fluid comprises at least one of the following: water; brine; an acid; or a base.

9. The method of claim 8, wherein the degradation fluid is generated downhole.

10. The method of claim 8, wherein the degradation fluid is introduced into the wellbore.

11. The method of claim 7, wherein the degradable polymeric element chemically reacts with at least one material in the degradation fluid to decompose.

12. A method of manufacturing the sealing system of claim 1, the method comprising:

disposing the mandrel that carries the swellable element in a mold;

injecting a liquid composition into the mold under pressure;

applying a pressure to the mold; and curing the liquid composition;

wherein the cured liquid composition forms the degradable polymeric element disposed on the surface of the swellable element; the degradable polymeric element comprising the polyurethane.

13. The method of claim 12, wherein the mold further comprises a pair of spacers disposed at opposing ends of the mold, and the method further comprises disposing the mandrel that carries the swellable element between the pair of spacers.

14. The method of claim 12, wherein the temperature applied to the mold is about 60° C. to 150° C. and a pressure applied to the mold is about 1,000 psi to about 50,000 psi.

15. A method of manufacturing the sealing system of claim 1, the method comprising:

applying a liquid composition to a rotating swellable element disposed about the mandrel; and curing the liquid composition applied to the swellable element;

wherein the cured liquid composition forms the degradable polymeric element disposed on a surface of the swellable element; the degradable polymeric element comprising the polyurethane.

16. The method of claim 15, wherein curing the liquid composition comprises heating the liquid composition applied to the swellable element.

* * * * *